United States Patent [19]

Murayama et al.

[11] Patent Number: 4,784,187

[45] Date of Patent: Nov. 15, 1988

[54] SHEDDING MOTION OF LOOM

[75] Inventors: Yoshiji Murayama; Hide Kobayashi, both of Toukamachi, Japan

[73] Assignee: Sandy Cloth Co., Ltd., Niigata, Japan

[21] Appl. No.: 38,825

[22] Filed: Apr. 15, 1987

[30] Foreign Application Priority Data

Apr. 22, 1986 [JP] Japan ..... 61-92914

[51] Int. Cl.[4] ..... D03D 29/00

[52] U.S. Cl. ..... 139/33

[58] Field of Search ..... 139/29, 30, 33

[56] References Cited

U.S. PATENT DOCUMENTS

| | | | |
|---|---|---|---|
| 2,139,879 | 12/1938 | Clark et al. | 139/33 |
| 4,462,432 | 7/1984 | Sajo et al. | 139/33 |

FOREIGN PATENT DOCUMENTS

| | | | |
|---|---|---|---|
| 1082568 | 7/1980 | Canada | 139/33 |
| 838485 | 3/1939 | France | 139/33 |
| 2344658 | 10/1977 | France | 139/33 |
| 450500 | 8/1949 | Italy | 139/33 |
| 61-138741 | 6/1986 | Japan | 139/33 |
| 1460531 | 1/1977 | United Kingdom | 139/33 |

*Primary Examiner*—Henry S. Jaudon

*Attorney, Agent, or Firm*—Wenderoth, Lind & Ponack

[57] ABSTRACT

A device for producing shedding motion in a loom includes two assembled guides disposed parallel in the loom. Each of the guides includes a shaft to which a plurality of blocks are mounted. The blocks not only cross feed yarn in the loom but transfer the yarn from the block to block during rotation of the shafts to produce a shedding motion for weaving multi-shaft woven fabric.

1 Claim, 6 Drawing Sheets

SHEDDING MOTION OF LOOM

BACKGROUND OF THE INVENTION

1. Field of the Invention

This invention relates to a device for producing shedding motion in a loom for weaving a multi-shaft woven fabric.

2. Description of the Prior Art

The looms, which have heretofore been known, are ones wherein wefts are perpendicularly woven into rectilinearly advancing warps, for weaving a so-called two-shaft woven fabric. And, recently, a demand has been voiced for multi-dimensional reinforcing ground fabrics for various composite materials, i.e. multi-shaft woven fabrics, in a wide range of fields including those involved in aerospace applications and applications for the motor vehicle industry, the electric and other general industries.

However, with the existing looms, it is impossible to weave multi-shaft woven fabrics, and therefore, it has been strongly desired to develop looms capable of weaving multi-shaft woven fabrics.

SUMMARY OF THE INVENTION

An object of the present invention is to provide a device which produces shedding motion in a loom, wherein, in order to make it possible to weave a multi-shaft woven fabric, which has heretofore been considered impossible to be produced, cross feed of warps for obliquely feeding the warps to the cloth fell, shedding and beating are continuously performed at the same time.

BRIEF DESCRIPTION OF THE DRAWINGS

The above object, features and advantages of the present invention, as well as other objects and advantages thereof, will become more apparent from the description of the invention which follows, taken in conjunction with the accompanying drawings, wherein like reference characters designate the same or similar parts and wherein.

DETAILED DESCRIPTION OF THE PREFERRED EMBODIMENTS

The present invention will be described in detail with reference to the accompanying drawings which illustrate a preferred embodiment of the present invention.

Figure 1:
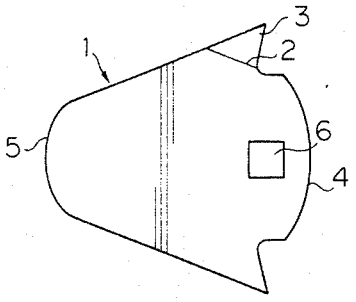
FIG. 1 is a plan view showing one example of a single plate used in a device for producing shedding motion in a loom according to the present invention.
Figure 2:
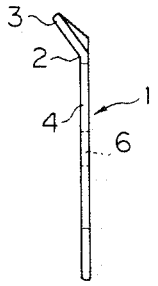
FIG. 2 is a side view of the single plate shown in FIG. 1.
Figure 3:
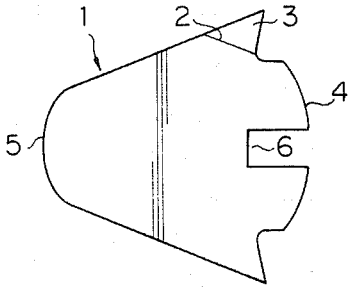
FIG. 3 is a plan view showing another example of the single plate.
Figure 4:
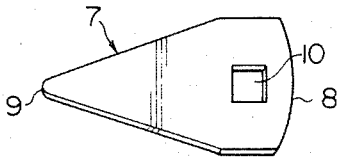
FIG. 4 is a perspective view showing an example of a washer which is clamped between two single plates in the device according to the present invention.

One end portion of a broader width top portion 4 of a thin rigid metal plate 1 having a generally segmental shape is bent along a bending line 2 to define a generally triangular bent portion 3, and a shaft couple-in opening 6 is formed in the center of a portion of the metal plate, close to the broader width top portion 4 thereof (refer to FIGS. 1 to 3). As shown in FIGS. 1 and 2, the shaft couple-in opening 6 may be a hole, or, as shown in FIG. 3, may be a groove cut out from the side of the broader width top portion 4.

Figure 5:
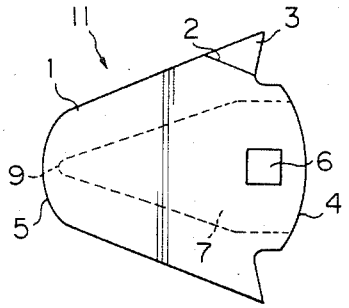
FIG. 5 is a plan view showing one example of a block formed by clamping the washer between two single plates thereby producing three integral layers.
Figure 6:
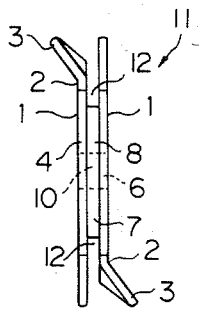
FIG. 6 is a right side view of the block shown in FIG. 5.

Two single plates 1 and 1 having the above-described arrangement are prepared. These two single plates 1 and 1 are superposed on each other with a washer 7 clamped therebetween, which washer is smaller in size than the single plates. The bent portions 3 and 3 are directed outwardly from each other and are disposed symmetrically in the lateral direction. The peripheral edge of the thus clamped washer 7 for the single plate, i.e. a space formed by the washer 7 between the two single plates 1 and 1 serves as a yarn guide 12, and a washer base portion 9 of the washer 7, positioned on the side of a single plate base portion 5 serves as a yarn pressor. Thus, a block 11 is provided (refer to FIGS. 5 and 6). The washer 7 has a generally similar configuration to that of the single plate 1. The top portion 8 of the washer 7 coincides with the broader width top portions 4 and 4 of the single plates 1 and 1, which are superposed on each other, and the washer base portion 9 serving as the yarn pressor is positioned on the side of the single plate base portion 5 and is clamped by the two single plates 1 and 1.

Furthermore, the washer 7 has an opening 10 formed therein that is aligned with the shaft couple-in openings 6 formed in the single plates 1 and 1 when the washer 7 is clamped by the two single plates 1 and 1. It is preferable to integrally fix the two single plates 1 and 1 to the washer 7 by adhesive bonding, welding or the like when the washer and the two single plates 1 and 1 are superposed.

Figure 9:
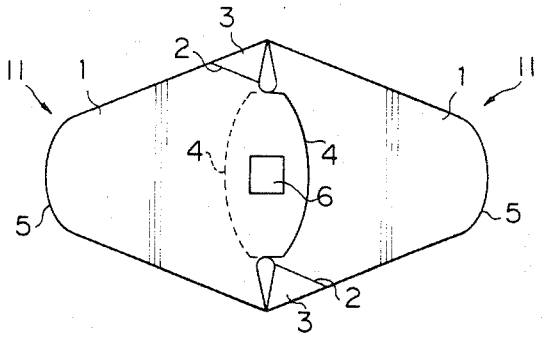
FIG. 9 is a plan view showing two blocks assembled in a relationship in which the blocks are opposed and are symmetrical in the lateral direction with respect to each other.
Figure 10:
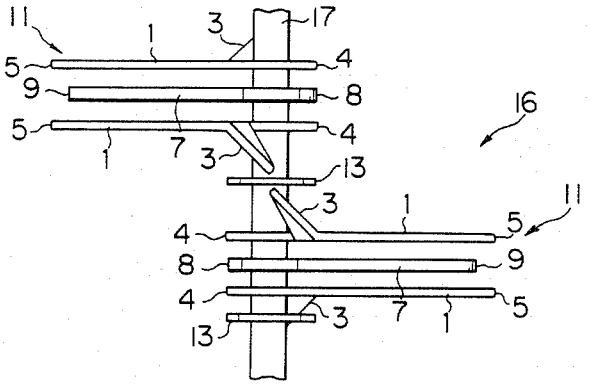
FIG. 10 is a disassembled explanatory view showing a shaft inserted through shaft couple-in openings of the blocks of FIG. 9 to thereby form an assembled guide.
Figure 11:
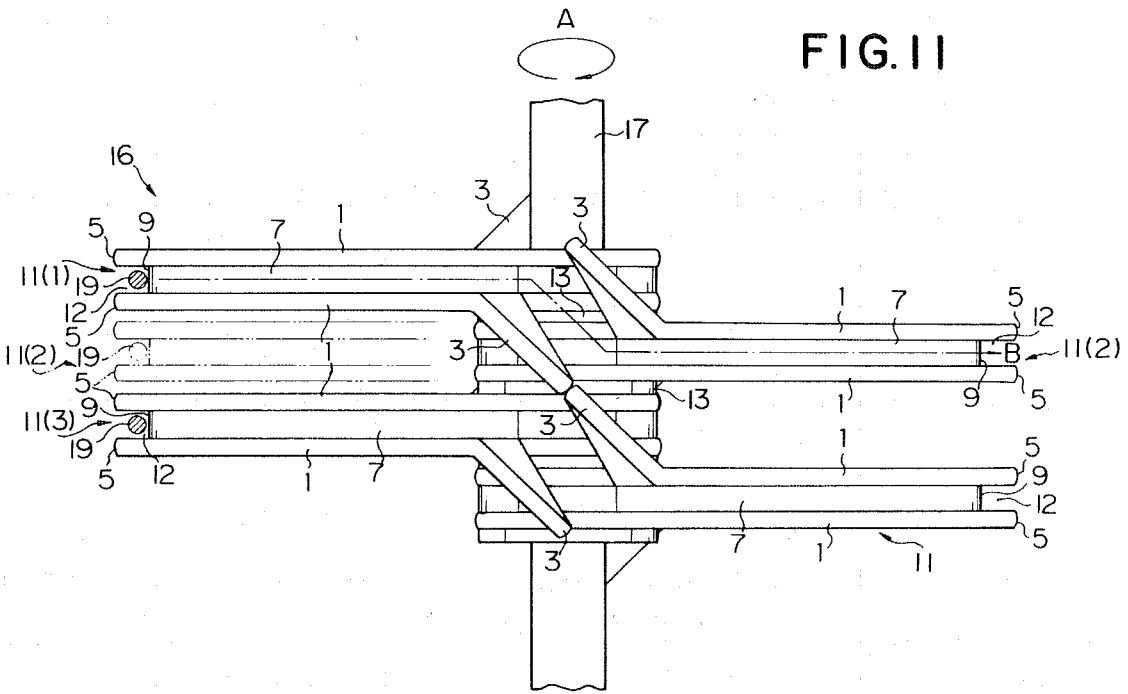
FIG. 11 is an enlarged front view showing part of the assembled guide shown in FIG. 10 and illustrating the function of feeding warps.

A plurality of the blocks 11, corresponding to the number of warps, are constructed. The plurality of blocks 11 and 11 are disposed against each other at the broader width top portions 4 and 4 and, the respective shaft couple-in openings 6 and 6 are aligned and the blocks are alternately and symmetrically assembled together (refer to FIG. 9). A shaft 17 is inserted into the shaft couple-in openings 6 and 6 of the thus assembled guide 16 (refer to FIGS. 10 and 11). In the thus alternately assembled blocks 11 and 11 shown in the drawings, the bent portions 3 and 3, which are formed at ends on one side of the broader width top portions 4 and 4, respectively, are fixed with respect to the shaft 17 in a positional relationship with a predetermined distance therebetween. With reference to FIG. 11, a first bent portion 3 of a lower single plate 1 of a first block 11 and a second bent portion 3 of an upper single plate 1 of a second block 11 adjacent the first block 11 are opposed to each other across a predetermined distance. The first bent portion 3 of the single plate 1 of the first block 11 blocks a yarn guide 12 of the second block 11, while the second bent portion 3 of the single plate 1 of the second block 11 blocks a yarn guide 12 of the first block 11.

Figure 7:
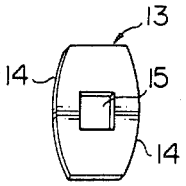
FIG. 7 is a perspective view showing another example of a washer for a block.
Figure 8:
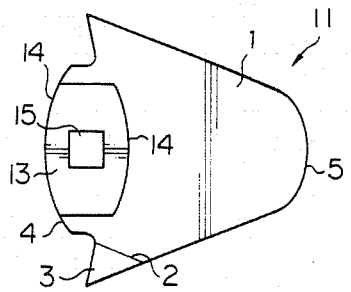
FIG. 8 is a plan view showing the washer of FIG. 7 superposed on a single plate when the block is assembled.

Provided between and coupled with the blocks 11 and 11, is a washer 13 mounted to shaft 17 for setting an interval between the blocks 11 and 11. An opening 15 to be received by the shaft 17 is formed in the central portion of this washer 13, and the top portions 14 formed on the opposite sides of the washer 13 coincide with the broader width top portions 4 and 4 of the single plates 1 and 1 of the block 11 (refer to FIGS. 7 and 8).

Two sets 16*a* and 16*b* of the assembled guides 16 thus constructed are prepared. The two sets of assembled guides 16*a* and 16*b* are provided in parallel in the loom, not shown, in a positional relationship in which blocks 11*a* and 11*b* of the assembled guides 16*a* and 16*b* are brought into meshing engagement and are rotated with shafts 17*a* and 17*b* about the rotational axes thereof, respectively. The respective assembled guides 16*a* and 16*b* are rotated with the shafts 17*a* and 17*b* in directions opposed to each other (directions indicated by arrows D) in the drawings and at equal speeds, thus producing the shedding motion 24 according to the present invention.

The function of the assembled guide 16 will hereunder be described in more detail with reference to FIG. 11.

As described above, the assembled guide 16 is of such an arrangement that the plurality of blocks 11, corresponding to the number of warps, are mounted on and fixed to the shaft 17 alternately and symmetrically with respect to the lateral direction. FIG. 11 partially shows the assembled guide 16.

First, when a warp 18 is guided around the yarn guide 12 of the block 11(1), tensioning the warp 19 to the extent that the warp 19 is brought into pressing contact with the peripheral edge of the washer 7, and when the shaft 17 is rotated in a direction indicated by arrow A, the warp 19 is guided and transferred along the yarn guide 12 in the chain line direction indicated by arrow B. More specifically, the warp 19 transferred along the yarn guide 12 of the block 11(1) is engaged with and guided by a bent portion 3 of the upper single plate 1 of a downwardly adjacent block 11(2), which bent portion 3 blocks the yarn guide 12 of the block 11(1) and transfers warp 19 to a yarn guide 12 of the block 11(2). Accordingly, when the shaft 17 is rotated in the direction indicated by arrow A, the warp 19 is guided around the yarn guide 12 of the block 11(1) in a predetermined direction under a predetermined tension. During a first ¼ turn of the shaft 17, the bent portion 3 at the top of the block 11(2) engages the warp 19 being guided by the yarn guide 12 of the block 11(1) and guides the same to the yarn guide 12 of the block 11(2), and, by ½ a turn, the block 11(2) is rotated and transferred to a position indicated by the two-dot chain line in FIG. 11, whereby the warp 19 is cross-fed over one block. Furthermore, by ¾ of a turn, the warp 19, which has been transferred to the yarn guide 12 of the block 11(2), engages the bent portion, not shown, of an upper single plate 1 of the subsequent block 11(3) and is guided to a yarn guide 12 of the block 11(3), and, by one full turn, the warp 19 is transferred to the yarn guide 12 of the block 11(3). In other words, by one full turn of the shaft 17, the warp 19 is transferred and cross-fed over two blocks. Consequently, the warps 19 are respectively guided by the multiplicity of blocks 11, whereby, during turning of the shaft 17, the threads of warps 19 are simultaneously cross-fed over one block, so that the warps 19 can be obliquely fed to the cloth fell.

The two sets of assembled guides 16*a* and 16*b* performing the above-described function are provided in parallel in the loom in a positional relationship in which the blocks 11*a* and 11*b* of the assembled guides 16*a* and 16*b* are brought into meshing engagement and are rotated with the shafts 17*a* and 17*b* about the rotational axes thereof, respectively, in directions opposed to each other and at equal speeds, thus providing the shedding motion 24 according to the present invention. The above-described shedding motion 24 will hereunder be described in more detail with reference to FIGS. 12 and 13.

Figure 12:
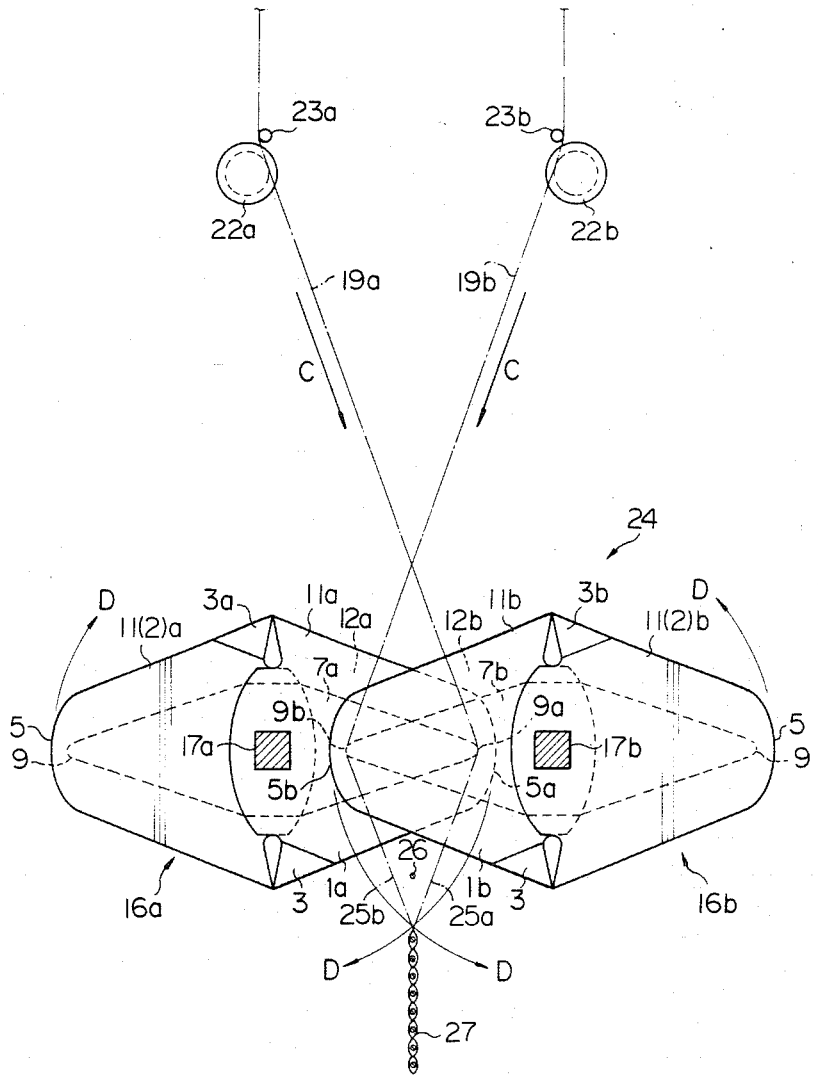
FIGS. 12 and 13 are plan views illustrating the shedding motion in the loom produced by the shedding device according to the present invention.

First, a group of warps to be fed is divided into two subgroups 19*a* and 19*b*. One of the subgroups of the warps 19*a* is guided to the assembled guide 16*a* in a direction indicated by arrow C and is separated into respective yarns, and each yarn is passed through a yarn guide 12*a* of each of the blocks 11*a* to become a cloth fell warp 25*a*. Furthermore, the other of the subgroups 19*b* of the warps is guided to the assembled guide 16*b* in a direction indicated by arrow C, and similarly, is separated into respective yarns, and each yarn becomes a cloth fell warp 25*b*. In this state, when the shafts 17*a* and 17*b* are rotated in the directions opposed to each other (directions indicated by arrows D) and at equal speeds, as shown in FIG. 12, first, the guided warps 19*a* and 19*b* to be fed are pushed out in directions opposed to each other by washer base portions 9*a* and 9*b* of washers 7*a* and 7*b* serving as yarn pressors and between which yarn guides 12*a* and 12*b* of the block 11*a* and 11*b* are defined, the warps 19*a* and 19*b* being fed across each other, thereby bringing about a shed state.

Figure 13:
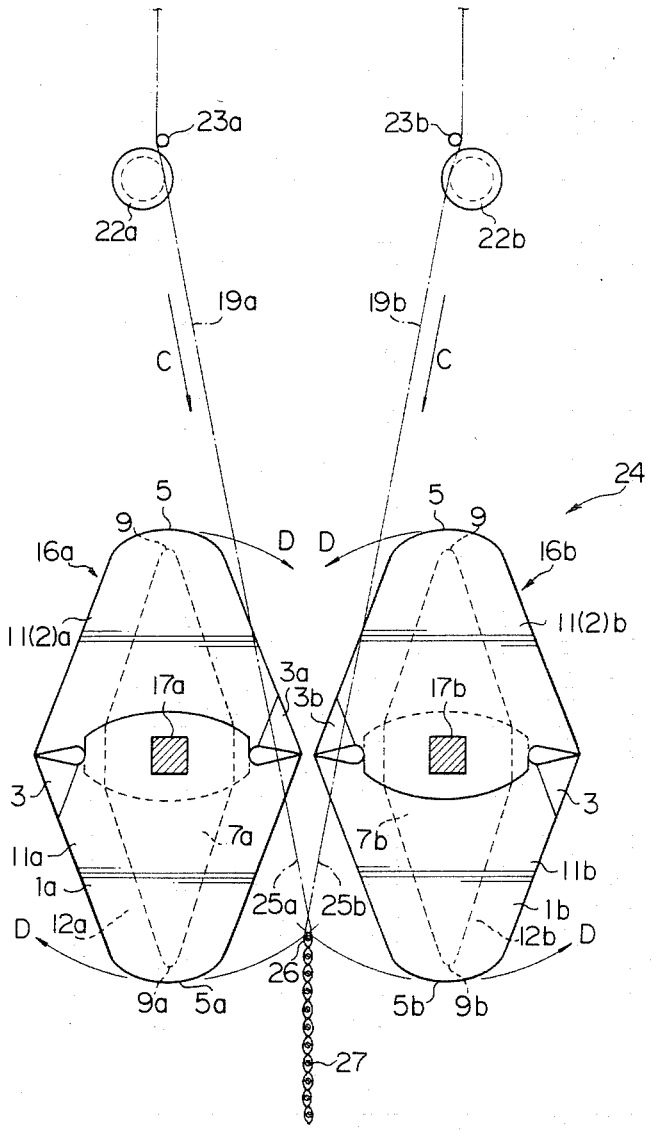

At maximum shedding between the warp 19*a* and 19*b* to be red, a weft 26 is woven into the shedding between the cloth fell warps 25*a* and 25*b*. FIG. 13 shows a state from which the first ¼ turn is made. Again, with reference to FIG. 11, the warps 19*a* and 19*b* guided by the block 11*a* and 11*b* are simultaneously cross-fed by one block, respectively, by bent portions 3*a* and 3*b* of adjoining blocks 11(2)a and 11(2)b, the cloth fell warps 25*a* and 25*b* are obliquely crossingly fed relative to a direction of gray cloth. Simultaneously, the weft 26 woven into a shedding formed between the cloth fell warps 25*a* and 25*b* is urged toward a woven fabric 27 by single plate base portions 5*a* and 5*b* of single plates 1*a* and 1*b* of the rotating blocks 11*a* and 11*b*, namely, is subjected to beating. Furthermore, when a ¼ turn of the shafts is made from this state, the state shown in FIG. 12 is brought about, namely, one in which the cloth fell warps 25*a* and 25*b* have formed a shedding into which the weft 26 has been woven. When the shafts 17*a* and 17*b* make one turn in the manner described above, the warps 17*a* and 19*b* are cross-fed over two blocks, and the weft 26 is woven into the shedding twice.

Designated by reference numerals 22*a* and 22*b* are warp feeding guide rolls, which are provided with helical grooves corresponding to the number of warps 19*a* and 19*b*, respectively. Reference numerals 23*a* and 23*b* designate pressor bars for pressing the warps 19*a* and 19*b* into the grooves formed on the warp feeding guide rolls 22*a* and 22*b*.

As described above, the shedding motion is produced in the loom by the present invention in which parallel assembled guides are rotated in direction opposed to each other, cross feed of the warps, shedding operation of the warps and beating are continuously performed at the same time, the cross-fed cloth fell warps are obliquely and crossingly fed relative to the direction of gray cloth and shed, and the weft is woven into the shedding in this shed state, whereby multi-shaft woven fabric, which has heretofore been considered impossible to produce, can be readily woven. Furthermore, the shedding motion is produced by the present invention which, has a simple construction and is easy to manufacture, and moreover, is mountable on a conventional loom whereby the present invention has inexpensive installation costs so that producing the multi-shaft woven fabric is economical. Additionally, the shedding motion is produced by the present invention which comprises a novel mechanism entirely different from a conventional shedding and beating mechanism not only with respect to the function of cross-feeding of the warps but also with respect to the performance of the shedding operation and the beating. In the shedding motion produced by the present invention, no warp is damaged and no noises peculiar to the beating occur and the shedding motion produced by the present invention is preferable with regard to material quality and the protection of the environment. Furthermore, if the warp cross feed mechanism is omitted, then the shedding motion produced by the present invention can be advantageously utilized for weaving of conventional two-shaft woven fabrics. It may be said that the shedding motion produced by the present invention can be used for many purposes.

What is claimed is:

1. A device for producing shedding motion in a loom, said device comprising:

two assembled guides mounted in the loom parallel to one another, each of said assembled guides comprising a shaft rotatably mounted in the loom and a plurality of blocks coupled to said shaft so as to rotate therewith, said blocks each having a couple-in opening extending therethrough and through which said shaft extends, each of said blocks comprising a pair of thin rigid metal plates and a washer fixed to and extending between said pair of thin rigid metal plates, each said rigid metal plate having a segmental shape including a base portion, a broad top portion, an opening extending therein at a substantially central location of said broad top portion, and a bent portion disposed adjacent a side of and inclined with respect to said broad top portion, each said washer having a respective opening extending therein and a base portion, and each said washer being smaller than the pair of rigid metal plates between which the washer extends, and wherein the openings extending in each of said thin rigid metal plates and in the washer extending therebetween of each of said blocks are aligned to define respective ones of said couple-in openings, the broad top portions and the base portion of each of said rigid metal plates of each of said blocks are aligned, and the bent portions of said pair of metal plates of each of said blocks are inclined outwardly away from the washer extending between said plates and are disposed at opposite sides of the aligned broad top portions from one another, adjacent ones of the entirety of said plurality of blocks of each of said assembled guides extend in opposite directions from one another with respect to the shaft of the assembled guide to which said blocks are mounted, the outer peripheral edge of said base portions of each of said washers is spaced from the outer peripheral edges of each of the pair of rigid metal plates between which said washers extend to define respective yarn guides for guiding yarn in the loom between said rigid metal plates and the outer peripheral edges of said base portions of said washers, said base portions of the washers in each of said assembled guides define respective yarn pressors for pressing the yarn in a direction away from the respective shafts of each of said assembled guides as said shafts rotate, and said plurality of blocks of one of said assembled guides and said plurality of blocks of the other of said assembled guides are in a meshing engagement in which said respective yarn pressors cross the yarn guided in the respective yarn guides of said one of said assembled guides with the yarn guided in the respective yarn guides of the other of said assembled guides as the shafts of said assembled guides are rotated in opposite directions in the loom, and one of the bent portions in each respective one of said plurality of blocks of each of said assembled guides blocks a respective said yarn guide of one of said plurality of blocks disposed adjacent thereto in the respective assembled guide so that the yarn guided in the yarn guides of said each respective one of said blocks is respectively transferred to the yarn guides of said blocks adjacent thereto as the shaft of said respective assembled guide is rotated.

* * * * *